United States Patent [19]

Obata et al.

[11] 4,211,628

[45] Jul. 8, 1980

[54] ELECTROLYTIC BATH ASSEMBLY

[75] Inventors: Kanichiro Obata, Matsudo; Yoshikazu Kokubu; Isao Okazaki, both of Iwaki, all of Japan

[73] Assignee: Kureha Kagaku Kogyo Kabushiki Kaisha, Tokyo, Japan

[21] Appl. No.: 944,356

[22] Filed: Sep. 21, 1978

[30] Foreign Application Priority Data

Oct. 21, 1977 [JP] Japan ..... 52/126476

[51] Int. Cl.[2] ..... C25B 9/00; C25B 11/03

[52] U.S. Cl. ..... 204/252; 204/283

[58] Field of Search ..... 204/282, 283, 257, 263, 204/252

[56] References Cited

U.S. PATENT DOCUMENTS

| | | | |
|---|---|---|---|
| 653,933 | 6/1900 | Moritz | 204/263 |
| 3,804,739 | 4/1974 | Bergeron | 204/283 |
| 4,013,525 | 3/1977 | Emsley | 204/283 |

FOREIGN PATENT DOCUMENTS

| | | | |
|---|---|---|---|
| 1434334 | 5/1976 | United Kingdom | 204/283 |
| 1434335 | 5/1976 | United Kingdom | 204/283 |
| 1479444 | 7/1977 | United Kingdom | 204/283 |

*Primary Examiner*—T. M. Tufariello

*Attorney, Agent, or Firm*—Fleit & Jacobson

[57] ABSTRACT

An electrolytic bath vessel assembly adapted for use to electrolytic treatment of salt water for the manufacture of caustic soda solution. The assembly includes a unique arrangement of bar electrodes, equidistantly positioned in parallel and at the both sides of a finely pored separating membrane.

5 Claims, 7 Drawing Figures

ELECTROLYTIC BATH ASSEMBLY

BACKGROUND OF THE INVENTION

This invention relates to improvements in and relating to separating membrane or diaphragm type electrolytic bath arrangements.

For carrying out the electrolysis of aqueous solution of solutes such as common salt, there are three main process modes classified as non-diaphragm mode electrolysis, diaphragm mode electrolysis and mercury electrolysis. As the separating membrane or diaphragm usable in the second of the above three known electrolytic processes, ion exchange membranes are rather preferably employed in the recent decade, in addition to porous membranes or diaphragms, as is well known to any person skilled in the art. Although the membrane or diaphragm electrolysis may be defined under occasion as different from the ion exchange membrane electrolysis by those skilled in the art, the membrane or diaphragm electrolysis as used herein and in the appended claims should be understood as including these both kinds of electrolysis.

For improving the energy efficiency in the membrane electrolysis, the kind of the membrane and the structure and arrangement of the electrolytic bath, as well as the material and structural arrangement of the electrodes must be jointly and specifically taken into account.

Among these factors, it should be noted that various and different proposals have long been made as for the structure and arrangement of component electrodes.

However, these proposals concern mostly with either anodic or cathodic electrode per se and it is rate to provide the overall and combined arrangement improvement for the anode and cathode jointly and as a whole.

In order to attain improvement in the electric energy efficiency, it is necessary to reduce the electrolytic service voltage for the electrolysis. For satisfying this requirement, the interelectrode distance must be reduced to a possible minimum, the developed gas or gases must be dissipated or removed as quickly as possible from the related electrode, so as to utilize the overall electrode surface in the most effective way. However, in practice, these requirements can not practically be satisfied with use of the currently available electrodes.

As the cathodic electrode, a plain woven soft steel wire net or a perforated soft steel plate or the like has hitherto been utilized preferentially. As an example, partially rolled wire nets, of 23 mm dia., 6 mesh, are being used representatively for almost all currently available membrane electrolytic bath units utilizing the deposit type asbestos separating membranes. It should be noted at first, however, in this case, that the plane parallelism of the wire net material as a whole is worse than desired, and thus, the electrode made therefrom represents as rough as plus/minus 2 mm at the minimum in its plane preciseness, thereby encountering with a substantial difficulty in minimizing the interelectrode distance and inviting a substantial uneveness thereof, which means naturally a grave defect in the art. When trying to minimize the inter-electrode distance beyond the normally allowable minimum dimensional limit in spite of the above uneveness and difficulty, unavoidable contact will occur locally among the anode, membrane and cathode at smallest interelectrode distance, thereby the membrane being subject to disadvantageous mechanical vibration and oscillation causing the membrane to slacken.

SUMMARY OF THE INVENTION

In the electrolytic bath vessel assembly according to this invention, it is a characterizing feature to provide two electrode groups as an anode and a cathode arranged at the both sides of a fine-pored separating membrane, each of said groups comprising a number of equidistantly and parallelly arranged bar electrodes, preferably round bars.

A further characterizing feature resides in such that the two grouped bar electrode are positioned in an opposed state relative to each other. Still a further characterizing feature resides in such that the anodic and cathodic bar electrodes are arranged in a zigzag arrangement as a whole.

In the electrolytic bath vessel according to this invention, all the bar electrodes are arranged vertically or horizontally.

The electrolytic bath vessel assembly according to this invention is further characterized by that the apparent interelectrode distance between the anode and the cathode is set to be smaller then the wall thickness of the separating membrane.

In the electrolytic bath vessel assembly according to this invention, the membrane is composed of an ion exchange membrane.

It is therefore the main object of the present invention to provide an improved and compact electrolytic bath assembly operable with better current efficiency at lower electrolytic voltage.

This and further object, features may become more apparent when read the following detailed description of the invention with reference to the accompanying drawings.

DETAILED DESCRIPTION OF PREFERRED EMBODIMENTS

In the following, several preferred embodiments of the invention will be described in detail.

Figure 1:
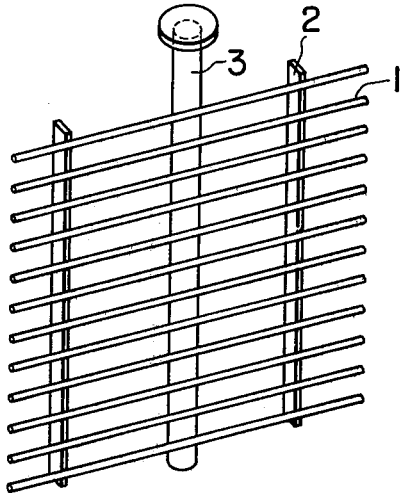
FIGS. 1 and 2 are perspective views of two different embodiments of the electrodes units constructed in accordance with the present invention.

In FIG. 1, the electrodes consist of a number of bars, preferably round bars 1, arranged horizontally parallel one after another and at equal mutual distances. These bars 1 are fixed in their mutual position by attaching from behind a plurality of vertically arranged stiffners or positioners, preferably rectangular bars 2. The fixed attachment can be made for assuring a better mechanical connection as well as a better electrical conduction by the electric welding technique, preferably spot- or resistance welding. The electrolytic action takes place naturally on the surface of the rod electrodes. A vertically arranged conductor 3 serves for the supply of electric current thereto. The conductor is welded directly to the rod electrodes at their rear surface, although not specifically illustrated in FIG. 1.

Figure 2:
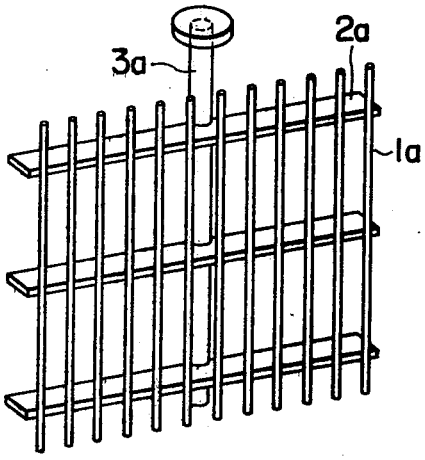

In the modified arrangement shown in FIG. 2, the bar electrodes are vertically arranged as at 1*a* and preferably equally spaced one after another as before. Stiffners or supporters 2*a* are arranged horizontally. Conductor 3*a* is arranged vertically as before and welded to the stiffners. Caution must be taken in this modified arrangement so as to avoid appreciable hindrance to gas rise which will occur during the electrolytic service of the electrolytic bath in which the electrode set is used in an dipped state as usual. For this purpose, it is preferable to reduce the width of the stiffner or positioner 2*a* to a certain minimum allowable size.

As a still further modified arrangement, although not specifically illustrated, the bar electrodes may be arranged in an inclined parallel state and the positioners and the conductor can be arranged in a correspondingly modified way.

The above novel arrangement of bar electrode assembly represents a rather more accurate plane preciseness than in the case of the conventional electrode such as plain-woven wire net, perforated metal plate or expanded metal type electrode.

The diameter of the bar electrode may preferably be 3–6 millimeters in consideration of its necessary rigidity for maintaining the plane preciseness of the electrode unit. In the similar way, the size and number of the bar positioners backing up to the bar electrodes may be properly selected in consideration of the plane preciseness as well as the easiness of manufacture. As an example, for such electrode arrangement as comprising 5 mm dia-soft steel rods, the positioners may be of 5 mm $\times$12 mm, and arranged at a mutual distance of 100 mm. In this case, the plane preciseness can be maintained within the range of $\pm$0.5 mm. On the contrary, with use of the same bar positioners, and with a 2.3 mm dia.-6 mesh wire net, only a rather inferior plane preciseness of $\pm$2 mm may be maintained.

Figure 3:
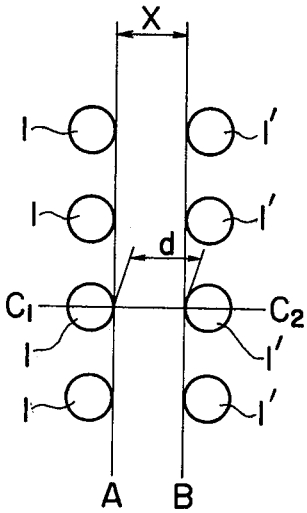
FIGS. 3 and 4 are partially sectioned and enlarged schematic end views of two different arrangements of the electrode groups each comprising a parallel arrangement of round bar electrodes.

In FIG. 3, a pair of bar electrode units are only partially and schematically shown, and arranged as an anode and a cathode in an electrolytic bath.

In this arrangement, both series of bar electrodes 1 and 1' are positioned horizontally, as is the case of that shown in FIG. 1, and further that the corresponding pairs of these bar electrodes are positioned in a horizontally opposed way. In this arrangement, it may be imagined that the left are anodes, while the right hand side series are cathodes. Between these two bar electrode series 1 and 1', there is provided a separating and finely pored membrane, although not shown. On account of the symmetrical arrangement of the both series bar electrodes, the left hand series may act as cathodes, while the right hand series may act as anodes, if occasion may desire.

Figure 4:
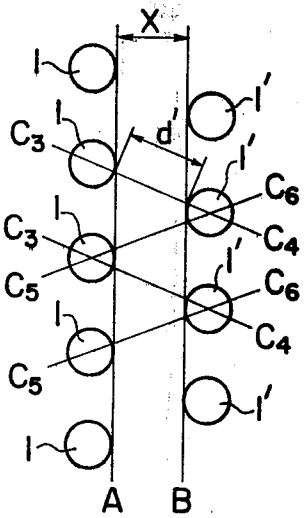

The arrangement shown in FIG. 4 is somewhat modified from the foregoing in such a way that the left hand series of bar electrodes 1 are positioned in a zigzag way to the right hand series of bar electrode 1'. It is assumed that the left electrodes 1 are anodes, while the right electrodes are cathodes, and vice versa. A separating and finely pored membrane is positioned between the both although not specifically illustrated.

In these both electrode arrangements, the interelectrode distance in each electrode series 1 or 1' may be deemed 10 cm or so with such assumption that the electrode diameter amounts to 5 mm or so. It may be easily deemed that one series electrodes can bodily be brought nearer to other series electrodes without fear of physical contact that the arrangement of FIG. 3.

In these both electrode arrangements, FIGS. 3 and 4, nearer imaginary tangential planes to these both electrode series 1 and 1' are shown at A and B, respectively, the working or opposite apparent interelectrode distance being shown at X as defined by and between these imaginary planes A and B in each case. On the other hand, the real and opposite interelectrode distance is shown at d and d' in FIGS. 3 and 4, respectively, as defined along the center line $C_1$–$C_2$ (FIG. 3) and $C_3$–$C_4$ or $C_5$–$C_6$, and by and between two correctly and obliquely opposing electrodes surfaces.

Figure 5:
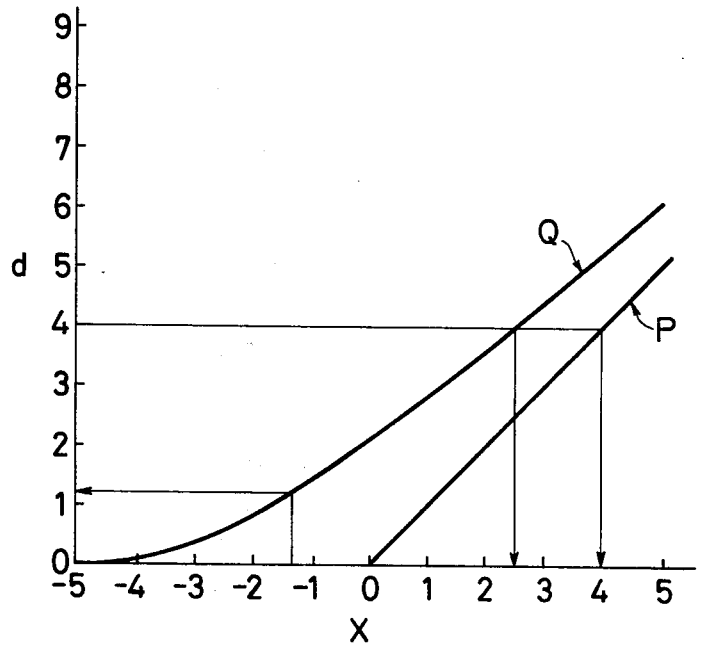
FIG. 5 is a diagram showing the relationship of the apparent interelectrode distance and the effective interelectrode distance in the two electrodes arrangements shown in FIGS. 3 and 4.

Preferred dimensional relationship between d and X is shown by a curve P in FIG. 5, for the arrangement shown in FIG. 3. In the similar way, the dimensional relationship between d and X is shown by the curve Q in FIG. 5 which is applicable to the modified electrode arrangement shown in FIG. 4.

As clearly seen from the foregoing, the apparent opposite interelectrode distance X is the same as the effective opposite interelectrode distance d in the electrode arrangement shown in FIG. 3. In the modified arrangement shown in FIG. 4, however, the corresponding effective interelectrode distance d' is always larger than the apparent distance X. When it is assumed that the effective distance d or d' is 4.0 mm, the apparent one X will be 4.0 mm in the case of the arrangement of FIG. 3, as was referred to and as will be clearly understood from FIG. 4. Under the same condition, the corresponding apparent distance d' will be however, 2.5 mm in the case of FIG. 4, as may be well understood from FIG. 5.

With using of wire net or similar conventional electrodes and when assuming that the plane electrode preciseness is kept at $\pm$2 mm, as was already referred to hereinbefore, and if the opposite interelectrode distance is assumed to be 4.0 mm, then occasional minimum effective opposite interelectrode distance could be 0 mm which means such that the opposite electrodes would be physically brought into contact with each other. In the case of the inventive electrode arrangement wherein the plane electrode preciseness can be maintained easily within 0.5 mm, the effective opposite interelectrode distance will be 3 mm which value is enough to employ in the practical electrolytic service. And under occasion, this value can be still shortened with safety.

In the case of the zigzag electrode arrangement shown in FIG. 4, and when the apparent opposite interelectrode distance is assumed to be 2.5 mm, the effective interelectrode distance d' will be maintained at 4.0 mm, as will be clearly estimated from FIG. 5. Even if the apparent interelectrode distance be fixed to a negative value such as $-1.5$ mmm the effective interelectrode distance may be maintained at 1.2 mm. In this case, when the imaginary surface preciseness of the electrode arrangement is kept at $\pm$0.5 mm as before, the anodic and cathodic bar electrodes 1 and 1', FIG. 4, can not be brought into physical contact and thus, the both interelectrode distance can be amazingly shortened in comparison with the conventional wire nets or the like electrodes. The shortened effective interelectrode distance has an intimate relationship with a corresponding reduction of the electrolytic voltage, while the shortened apparent interelectrode distance will bring a correspondingly economized utilization of the floor space of the electrolytic plant.

As the merits of the electrode arrangement shown in FIG. 3, the favourable preciseness of the imaginary overall electrode plane and the highly shortened interelectrode distances in the imaginary sense, as well as in the practical and effective service. As a further merit, the gases developing during service will rise up from the bath easily without appreciable hindrance into the corresponding gas accumulation chambers formed above the bath liquid level and within the electrolytic bath vessel. It has been, however, experienced that with the electrode assembly shown in FIG. 3, the electrolytic resistance is relatively small when the opposite interelectrode resistance is set to the order of 1 mm, while the current density is large and the gas developing quantity is high, the electrolytic resistance becomes suddenly large if the opposite electrode distance is set to 2 mm or lesser.

However, in the case of the zigzag electrode arrangement as shown in FIG. 4, the electrolytic resistance will be further decreased even if the apparent and opposite interelectrode distance should take a negative value. The reason may be easily understood from FIG. 6 and its explanation to follow.

Figure 6:
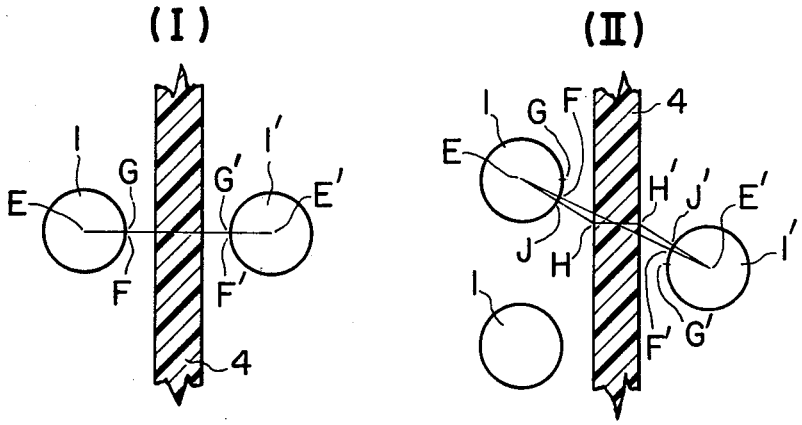
FIG. 6 (I) and (II), are partially sectioned schematic end views of two different arrangements of bar electrodes arranged at the both sides of a fine-pored separating membrane and remote therefrom.

In FIG. 6 at (I), a finely pored separating membrane is illustrated in its section. A pair of anode 1 and cathode 1' are represented only representatively. Thus, it can be deemed that this arrangement shows only a part of the electrode arrangement shown in FIG. 4. Thus, the anode and cathode are arranged in parallel to the membrane and in opposition to each other at the both sides thereof and with equal distances therefrom.

As seen, the mutually nearest working points of these round electrodes 1 and 1' are denoted at F and F' which are on the common diameter connecting the centers E and E' of these electrodes. During electrolytic service, the electric fluxes are most concentrated at these points F and F'. The developing gases are also most concentrated at these truely opposite portions of the electrodes. Symbols G and G' denote those points on the opposite electrodes which are positioned nearest to the separating membrane. In the present embodiment, however, the former points, more correctly ridges, F and F' correspond respectively to the latter points, again more correctly ridges, G and G'. When the interelectrode distance is gradually reduced, these ridges F and F' will be brought correspondingly nearer to the membrane 4. With gradual shortening of the interelectrode distance, the opposing ridges will contact the membrane 4. Before such contact, a plenty amount of gas will develop in close proximity to the membrane, thus the latter being pressed against the opposite electrode series under the influence of the gas pressure upon displacing the electrolytic bath liquid existing between the membrane and the gas-developing electrode series. In this way, the electrolytic voltage will drop. These phenomena, if happened to take place, will act naturally defective in the electrolytic service.

With the modified, zigzag-mode electrode arrangement shown in FIG. 4 as well as FIG. 6 at (II), the aforementioned ridges F and F' lying on the common diameter E–E' are slightly remote from the other ridges G and G' opposing to the surfaces of the membrane 4, the former ridges F and F' will not be brought into contact with the membrane, even if the latter ridges G and G' have contacted with it. On the other hand, it will be easily understood that the electric resistance of the membrane 4 which is most frequently an ion exchange one will amount to nearly ten times higher than that of the electrolytic bath liquid and thus it can well be assumed that the electrolytic current flows, during service, substantially prependicularly through the membrane wall, because the current prefers to flow a least resistance passage as possible from one to another of the obliquely opposed pair electrodes 1 and 1', thus substantially along a certain broken line passage such as E–H–H'–E', as shown in FIG. 6 at (II). The intersecting points J and J' of this current passage course with the peripheral surface of the electrodes 1 and 1', respectively, are positioned still far from the points or ridges F and F' in comparison with the another ridges G and G', thus being still far from the respective membrane surfaces. It will be further seen that the distances F–J and G–J will become larger with shortened distance between the membrane and the electrode arrangements. Thus, even if the both side electrodes are brought into contact with the respective membrane surfaces, the points where the development of gases is most energic, do not contact the membrane and the freshly developed gases may liably be escape to rise up from their developing points which are remote a certain distance obliquely and laterally from the contact points of the electrodes with the membrane. In this way, otherwise possible increase of the electrolytic resistance can effectively avoided, and indeed with increased operational merits obtained by the opposed interelectrode distances.

Figure 7:
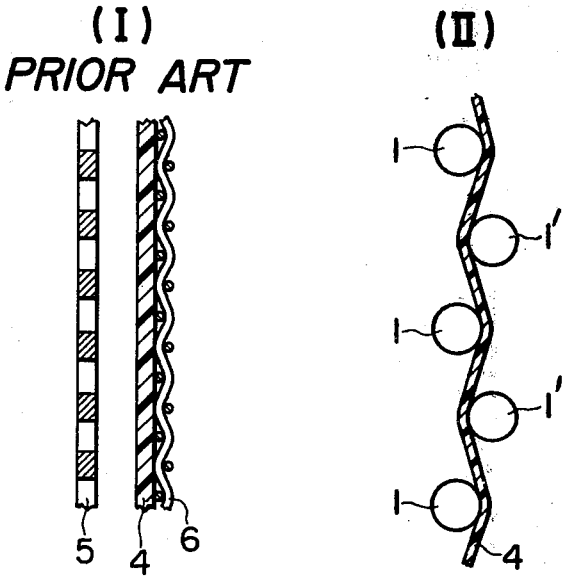
FIG. 7 (I) and (II), are two different partially sectioned end view of conventional and novel bar electrodes arrangements.

In FIG. 7 at (I), a conventional arrangement of electrode series 5 and 6 relative to a fine-pored separating membrane is shown only partially and schematically. The membrane denoted by the same reference numeral 4 as before. In this arrangement, it has been practically experienced that the membrane 4 becomes slackened during service by virtue of frequently encountered vibration and oscillation. Generally speaking, the membrane is pressed laterally with one side stronger pressure, so as to be kept in pressure contact with one preferred electrode series.

On the contrary, it will be remembered that in the inventive electrode arangement, as shown by way of example in FIG. 4, and further only partially and schematically shown in FIG. 7 at (II), the apparent interelectrode distance between two obliquely opposing electrodes, acting as anode and cathode, respectively, can be reduced to such a size which is smaller than the thickness of the membrane. In this way, the membrane can be held under pressure from its both sides by being kept in pressure contact in a zigzag way by the both side electrode series. In this way, otherwise possible vibration and oscillation of the membrane during its service period can be effectively avoided.

In the following, several numerical examples will be given for purposes of more clear and prompt understanding of the invention.

EXAMPLE 1

Two sets of electrode arrangements, as the anode and the cathode, substantially similar to those shown in FIGS. 1 and 4 were used. The overall width of each of these electrode arrangements amounted to 100 mm, having a height of 1,000 mm. These electrode arrangements were placed on the bottom of an electrolytic bath vessel, made of acrylic resin, not shown, a fine-pored separating membrane was arranged between these two electrode arrangements. Behind each of these anodic and cathodic electrode assemblies, there is provided a 50 mm—liquid space, so as to provide an anodic or a cathodic chamber, respectively. At the bottom of these anodic and cathodic chambers, a salt water inlet and a fresh water supply inlet were provided. Above each of these chambers, there was formed a liquid-gas separating chamber, having a width of 100 mm, a height of 100 mm and a thickness of 30 mm, respectively. The separating chambers were formed with chlorine gas outlet; dilute salt water outlet and gaseous hydrogen outlet; caustic soda outlet, respectively.

The anodic bar electrodes were of titanium, coated, however, with an active coating layer of PdO or its derivative. As the cathodic bar electrodes, those of soft steel were used.

The bar shape, main dimensions, mode of arrangement are tabulated in Table 1 to follow.

As the material for the membrane, "NAFION 324", manufactured and sold by E.I. Du'Pont. This membrane was pretreated by dipping in an aqueous 50—vol. %—solution at 60° C. for 3 hours before fitting in the electrolytic bath. The hydrogen gas pressure as measured at its outlet was kept higher by 200 mm Aq. than the chlorine gas pressure as measured at its outlet, so as to press the membrane against the anodic bar electrode arrangement for being carried thereby and for avoiding otherwise possible vibration and oscillation of these electrodes.

Behind the cathodic chamber, there is provided a steam heating jacket for keeping the electrolytic bath at 80° C.±2° C. The material salt water was fed at the rate of 50 cc/min. to the anodic chamber, while the fresh water was fed at the rate of 16 cc/min to the cathodic chamber.

The electrolytic conditions in the bath vessel became stable and substantially constant after 24 hours from initiation of the electrolysis. The resulted conditions together with the electrolytic data are shown in Table 2 to follow.

The electrolytic voltage in a comparative test to follow amounted to 3.9 volts, while in the present example, it was reduced to 3.3 volts with superior results.

EXAMPLE 2

Same arrangements of the bar electrodes as in the foregoing Example 1 were employed. However, the apparent interelectrode distance was set to nil. The "NAFION"-membrane was held squeezed between the anodic and cathodic bar electrode groups. In this case, the membrane was firmly held in a zigzag mode by and between the anodic and cathodic bar electrodes. In this way, a steady electrolytic operation was assured without inviting disadvantageous vibration and oscillation of the membrane. By virtue of further reduced interelectrode distance, the electrolytic voltage was further reduced to 3.2 volts.

COMPARATIVE TEST

Two conventional electrode groups as anode and cathode were employed, as is tabulated in Table 3 to follow. The overall dimensions of the electrolytic bath vessel and sizes of the separating chambers were same as before. The operating conditions were set to those while were employed in the foregoing Example 1. The results are tabulated in Table 4 to follow.

Table 1

Electrodes Dimensions and Combinations (Examples 1 and 2)

| Example | Apparent Inter-elec. Distance | Shape of Anode | Shape of Cathode | Mode of Arrangement |
|---|---|---|---|---|
| 1 | 4.0 mm | 5 mm-dia-round bars arranged vertically in parallel at 10-mm pitch | 5 mm-dia-round bars arranged vertically in parallel at 10-mm pitch | Zigzag Arrangement of Anodic and Cathodic Bar Electrodes |
| 2 | 0 | Same as in Exp. 1 | 5 mm-dia-round bars arranged vertically in parallel at 10-mm pitch | Zigzag Arrangement of Anodic and Cathodic Bar Electrodes |

Table 2

| | Example 1 | Example 2 |
|---|---|---|
| Conc. of Fed Salt Water | 310g, NaCl/lit. | 310 g, NaCl/lit. |
| pH of Above | 1.5 | 1.5 |
| Conc. of Discharged dilute Salt Water | 180g, NaCl/lit. | 180g, NaCl/lit. |
| Conc. of Formed Caustic Soda | 20.0 wt. % | 20.0 wt. % |
| Current Eff. Based on Formed Caustic Soda | 80–82% | 80–82% |
| Electrolytic Bath Temp. | 80° ± 2° C. | 80° ± 2° C. |
| Amperes | 300 | 300 |
| Current Density | 30 A/dm$^2$ | 30 A/dm$^2$ |
| Electrolytic Voltage | 3.3 volts | 3.2 volts |

Table 3

Shape and Arrangement of Bar Electrodes (Comparative Test)

| Comparative Test | Apparent Interelectrode Distance, mm | Shape and Material of Anode | Shape and Material of Cathode | Relative Arrangement of Anode and Cathode |
|---|---|---|---|---|
| No. 1 | 4.0 | Expanded Metal, LW1/2" ×SW1/4, 1.6 mm thick | Wire Net, of Plain Woven, 6-mesh, of 2.3 mm-diameter wires. | Correctly Opposed |

Table 4

Results of Electrolysis (Comparative Test)

| | |
|---|---|
| Conc. of Fed. Salt Water | 310 g, NaCl/lit. |
| pH of Fed Salt Water | 1.5 |
| Conc. of Formed Dilute Salt Water | 180 g, NaCl/lit. |
| Conc. of Formed Caustic Soda | 20.0 wt. % |
| Current Eff. Based on Formed Caustic Soda | 80–82% |
| Bath Temp. | 80° ± 2° C. |
| Amperes | 300 A |
| Current Density | 30 A/dm$^2$ |
| Electrolytic Voltage | 3.9 volts |

The embodiments of the invention in which an exclusive property or privilege is claimed are as follows:

1. An electrolytic bath vessel assembly, characterized by the provision of two electrode groups as an anode and a cathode arranged at the both sides of a fine-pored separating membrane, each of said groups comprising a number of equidistantly parallely arranged bar electrodes, preferably round bars, said two electrode groups being positioned in an opposed state relative to each other, wherein the anodic and cathodic bar electrodes are arranged in a zigzag arrangement.

2. The electrolytic bath vessel assembly of claim 1 characterized by that all the bar electrodes are arranged vertically.

3. The electrolytic bath vessel assembly of claim 1, characterized by that all the bar electrodes are arranged horizontally.

4. The electrolytic bath vessel assembly of claim 1, wherein the bar electrodes in each group are arranged with equal interbar distances therebetween and each group being arranged in relation to said membrane such that the apparent interpolar distance between the anode and the cathode is smaller than the thickness of said separating membrane, thereby forming said separating membrane into a wavy zigzag shape in alternate contact with said two groups of electrodes.

5. The electrolytic bath vessel assembly according to claim 1, characterized by that the membrane is composed of an ion exchange membrane.

* * * * *